US011993353B2

(12) United States Patent
Giai-Checa et al.

(10) Patent No.: US 11,993,353 B2
(45) Date of Patent: May 28, 2024

(54) BREATHING APPARATUS FOR SCUBA DIVING WITH SEMI-CLOSED CIRCUIT GAS RECYCLING

(71) Applicant: LA SPIROTECHNIQUE INDUSTRIELLE ET COMMERCIALE, Carros (FR)

(72) Inventors: Bernard Giai-Checa, Mouans-Sartoux (FR); Nicolas Peyron, Saint Jeannet (FR); Stéphane Rainaut, Saint Romain De Bellet (FR)

(73) Assignee: LA SPIROTECHNIQUE INDUSTRIELLE ET COMMERCIALE, Carros (FR)

( * ) Notice: Subject to any disclaimer, the term of this patent is extended or adjusted under 35 U.S.C. 154(b) by 819 days.

(21) Appl. No.: 17/049,928

(22) PCT Filed: Apr. 24, 2019

(86) PCT No.: PCT/EP2019/060464
§ 371 (c)(1),
(2) Date: Oct. 22, 2020

(87) PCT Pub. No.: WO2019/206963
PCT Pub. Date: Oct. 31, 2019

(65) Prior Publication Data

US 2021/0078683 A1 Mar. 18, 2021

(30) Foreign Application Priority Data

Apr. 24, 2018 (FR) ..... 1853577

(51) Int. Cl.
*B63C 11/24* (2006.01)
*B63C 11/18* (2006.01)
(Continued)

(52) U.S. Cl.
CPC ..... *B63C 11/24* (2013.01); *B63C 11/186* (2013.01); *B63C 11/12* (2013.01); *B63C 11/2209* (2013.01)

(58) Field of Classification Search
CPC ..... B63C 11/00; B63C 11/02; B63C 11/18; B63C 11/186; B63C 11/22;
(Continued)

(56) References Cited

U.S. PATENT DOCUMENTS 4,056,098 A 11/1977 Michel et al.
5,072,728 A 12/1991 Pasternack
(Continued)

FOREIGN PATENT DOCUMENTS

CA 2296338 A1 1/1999
DE 680053 C 8/1939
(Continued)

OTHER PUBLICATIONS

International Search Report from corresponding International Application No. PCT/EP2019/060464, dated May 27, 2019, pp. 1-3, European Patent Office, Rijswijk, The Netherlands.

*Primary Examiner* — Colin W Stuart
(74) *Attorney, Agent, or Firm* — HAUPTMAN HAM, LLP

(57) ABSTRACT

A semi-closed circuit gas recycling scuba diving breathing apparatus having a breathing loop. The breathing loop has a breathing bag to be supplied by at least one gas tank and a recycling chamber. The gas tank is connected to an inlet of the breathing bag by a first duct and a second duct having respectively a demand regulator and a fixed nozzle configured to deliver respectively a first gas input and a second gas input to the breathing bag. Advantageously, the apparatus has a third duct having a gas flow regulator configured to deliver at a variable mass flow, a third gas input to the
(Continued)

breathing bag, and a diving condition sensor, configured to measure a physiological parameter of the diver or the depth. The apparatus is advantageously configured to make the variable mass flow vary according to data of the sensor to optimise the consumption of gas.

18 Claims, 3 Drawing Sheets

(51) Int. Cl.
*B63C 11/12* (2006.01)
*B63C 11/22* (2006.01)

(58) Field of Classification Search
CPC ..... B63C 11/2209; B63C 11/24; B63C 2011/021; A62B 7/00; A62B 7/10
See application file for complete search history.

(56) References Cited

U.S. PATENT DOCUMENTS

| | | | | |
|---|---|---|---|---|
| 5,503,145 | A | 4/1996 | Clough | |
| 5,924,418 | A * | 7/1999 | Lewis ..... | B63C 11/24 128/204.22 |
| 6,003,513 | A | 12/1999 | Readey et al. | |
| 6,341,604 | B1 | 1/2002 | Kellon | |
| 6,408,847 | B1 | 6/2002 | Nuckols et al. | |

FOREIGN PATENT DOCUMENTS

| | | | |
|---|---|---|---|
| EP | 1911671 | B1 | 4/2008 |
| FR | 1538953 | A | 9/1968 |
| FR | 2641976 | A1 | 7/1990 |
| GB | 2201602 | A | 9/1988 |

* cited by examiner

BREATHING APPARATUS FOR SCUBA DIVING WITH SEMI-CLOSED CIRCUIT GAS RECYCLING

The present application is a National Phase of International Application Number PCT/EP2019/060464, filed Apr. 24, 2019, which claims priority to French Application No. 1853577, filed Apr. 24, 2018.

TECHNOLOGICAL FIELD

The present invention relates to a gas recycling breathing apparatus. It has at least one particularly advantageous application in the field of semi-closed circuit gas recycling scuba diving apparatuses.

TECHNOLOGICAL BACKGROUND

The gas recycling breathing apparatus or recycler is mainly used in the field of scuba diving. It makes it possible for a substantial saving of gas compared with a breathing apparatus operating in an open circuit (usually designated by the acronym OC, Open Circuit).

A recycler generally comprises a breathing bag wherein the diver breathes. The composition of gas in the breathing bag is mainly the result of the mixture between the fresh gas inputs and the recycled gas inputs.

The recycled gas is generally obtained by filtration or purification of gases exhaled by the diver. This filtration aims, in particular, to trap all or some of the carbon coming from the $CO_2$ contained in the exhaled gas, in order to release molecular oxygen ($O_2$). After filtration, the gas thus "recycled" can be reinjected in the breathing bag.

The fresh gas still contains oxygen ($O_2$), of which a variable portion is metabolised by the diver according to their physiological needs. The fresh gas can also contain one or more dilutants such as nitrogen ($N_2$).

The fresh gas input can be made in different ways. In particular, recyclers operating in a semi-closed circuit (SCR, semi-closed rebreather) and recyclers operating in a closed circuit (CCR, closed-circuit rebreather) are distinguished.

The present invention relates to, in particular, recyclers operating in a semi-closed circuit (SCR).

In the case of an SCR recycler, a usually superoxygenated gas is injected in the breathing loop with a constant mass flow. This flow is calculated to respond within acceptable physiological limits, to all ventilation systems and to all diver profiles.

FIG. 1 presents such a recycler comprising a breathing bag 3 supplied with gas by a demand regulator 110 (DD) and by a nozzle 120 delivering a fresh gas input with a constant mass flow (fixed nozzle). The breathing bag is also supplied with recycled air coming from a recycling chamber 61. This recycling chamber 61 receives air exhaled by the diver, traps the carbon dioxide from the exhaled air, typically in a lime cartridge and delivers a recycled air.

During diving, the excess gas, taken as being the different between the quantity of gas injected in the breathing bag 3 and the quantity of gas consumed by the diver, is evacuated by way of a pressure relief valve 31.

A disadvantage of such a solution is the wastage of this unconsumed excess gas.

In order to optimise the fresh gas input and to limit the wastage, document U.S. Pat. No. 6,408,847 B1 discloses, for example, an SCR recycler of which some of the fresh gas input varies according to the inhalation intensity of the diver. Such a solution comprises a valve mounted on the demand regulator, and controlled mechanically by a pressure-sensitive valve located on the inhalation side of the breathing loop. If the diver inhales deeply (so as to create a sufficient depression), the pressure-sensitive valve actuates, by a mechanical system, the valve mounted on the demand regulator. In response, this is opened and releases an additional fresh gas input.

In practice, it has proved to be that if the valve is faulty, the oxygen supply becomes insufficient, leading to putting the diver in danger. This solution is therefore not sufficiently reliable in terms of safety.

Several accidents have been observed with this type of solution. Due to these safety problems, the use and development of this solution have remained extremely limited.

To overcome this disadvantage, other solutions provide a sensor aiming to evaluate the oxygen content in the breathing bag. According to the oxygen content measured, the system injects pure gas ($O_2$) in the breathing bag so as to conserve a substantially constant oxygen pressure, at a fixed setpoint value. In practice, this solution has proved to be as problematic in terms of safety, since a failure of the oxygen sensor immediately puts the diver in danger.

The majority of solutions proposed to increase the reliability of these recyclers consist of multiplying the number of sensors and of pooling the measures thereof. This makes it possible to reduce the risks that a failure of one of the sensors interrupts the oxygen supply or, on the contrary, wastes a large quantity of oxygen. These solutions have the main disadvantage of increasing the complexity of the system, which leads to increasing the cost price thereof and making the maintenance thereof more difficult.

An aim of the present invention is to overcome at least partially some of the disadvantages mentioned above.

More specifically, the invention aims to propose a semi-closed recycling breathing apparatus having an improved safety level for the diver and offering a satisfactory diving duration.

SUMMARY

A first aspect of the invention relates to a semi-closed circuit gas recycling scuba diving breathing apparatus, intended to be carried by a diver, comprising a breathing loop intended to be connected to at least one gas tank, the breathing loop comprising:

- at least one mouthpiece intended for the diver and making it possible for the diver to breathe in the breathing loop,
- at least one recycling chamber connected to an outlet of the mouthpiece and intended to recycle at least some of a gas exhaled by the diver so as to supply a recycled gas, said chamber being configured to receive an exhaled gas filtration device, and
- at least one breathing bag having an outlet connected to an inlet of the mouthpiece, an inlet connected to an outlet of the recycling chamber and at least one inlet intended to be connected to at least one outlet of the at least one gas tank, the breathing bag being configured to make it possible for the mixture within it of the recycled gas coming from the recycling chamber and at least one gas input, called fresh gas, coming from the at least one gas tank.

The breathing apparatus further comprises a plurality of ducts making it possible for the connections in parallel between at least one inlet of the breathing bag and the at least one gas tank, preferably a plurality of outlets of the at least one gas tank, at least one first duct of said plurality of ducts being equipped with a first so-called fixed nozzle configured to deliver at a constant volume flow, and preferably at a constant mass flow, a first fresh gas input to the breathing bag.

Advantageously, the breathing apparatus further comprises:

- A second duct of said plurality of ducts. The second duct is equipped with a gas flow regulator. This gas flow regulator is configured to deliver at a variable volume flow and preferably at a variable mass flow, a second fresh gas input to the breathing bag.
- at least one diving condition sensor, to measure at least one diving condition parameter taken from among a physiological parameter of the diver and the pressure of the water surrounding said apparatus.

The breathing apparatus is advantageously configured to control the gas flow regulator so as to make said variable volume flow and preferably said variable mass flow vary, at least according to a relative item of data at said at least one diving condition parameter.

The diving breathing apparatus according to the invention thus makes it possible to modulate the fresh gas input by way of the variable volume flow nozzle. This gas input modulation depends on an item of data of the diving condition sensor and makes it possible advantageously to optimise the gas consumption (fresh air) according to a physiological parameter of the diver or the surrounding hydrostatic pressure. The fresh air wastage is thus reduced and the duration of the extended dive. The dive comfort is also increased. Furthermore, such an apparatus comprising three ducts offers a safety level which is greater than or equal to that of a conventional semi-closed apparatus comprising one or two ducts, in case of damage on one of said ducts. Indeed, a risk analysis considering different cases of damage on these ducts makes it possible to show that the probability of occurrence of a critical situation for such an apparatus found reduced vis-á-vis a conventional semi-closed breathing apparatus. This risk analysis is subsequently detailed.

According to an advantageous and preferred possibility, the at least one diving condition sensor is a physiological sensor and preferably a ventilatory frequency sensor.

Such a sensor advantageously makes it possible to consider the force supplied by the diver at each time of diving. Thus, the gas consumption is optimised according to the force of the diver.

The at least one diving condition sensor can further comprise a depth or pressure sensor configured to measure a diving depth.

According to a preferred embodiment, the breathing apparatus is configured such that the gas pressure at the inlet of the fixed nozzle is constant, for example equal to 15 bars. The breathing apparatus is preferably configured such that the gas pressure at the inlet of the gas flow regulator is constant, for example equal to 15 bars.

According to this embodiment, the density of the gas entering into the fixed nozzle and/or the gas flow regulator is constant, and the quantity of oxygen contained in this gas is advantageously constant, whatever the surrounding hydrostatic pressure. In this case, the mass flow delivered at the outlet of the fixed nozzle and/or gas flow regulator is advantageously proportional to the corresponding volume flow.

According to a particularly advantageous possibility, the breathing apparatus further comprises an electronic control module. This electronic module is preferably configured to electronically control the gas flow regulator so as to make the variable volume flow vary at least according to said item of data relating to said diving condition parameter.

This electronic control of the variable volume flow advantageously makes it possible to avoid resorting to mechanical solutions requiring, for example, a manipulation by the diver (quick change of connectors with the aim of changing nozzle type, manual adjustment).

A second aspect of the invention relates to a kit intended to equip a semi-closed circuit gas recycling scuba diving breathing apparatus intended to be carried by a diver.

This kit comprises at least:

- one gas flow regulator configured to deliver at a variable volume flow and preferably at a variable mass flow, a second fresh gas input by at least one duct connected to the breathing bag and to the at least one gas tank of the breathing apparatus,
- at least one diving condition sensor, configured to measure at least one diving condition parameter taken from among a physiological parameter of the diver and the pressure of the water surrounding said apparatus, said at least one sensor being configured to be carried by at least one from among the apparatus, the kit and the diver,
- an electronic control module configured to control the gas flow regulator so as to make said variable volume flow and preferably variable mass flow vary, at least according to an item of data relating to said at least one diving condition parameter.

BRIEF INTRODUCTION OF THE FIGS

Other features, aims and advantages of the present invention will appear upon reading the following detailed description, and regarding the appended drawings given as non-limiting examples and wherein.

DETAILED DESCRIPTION

Figure 1:
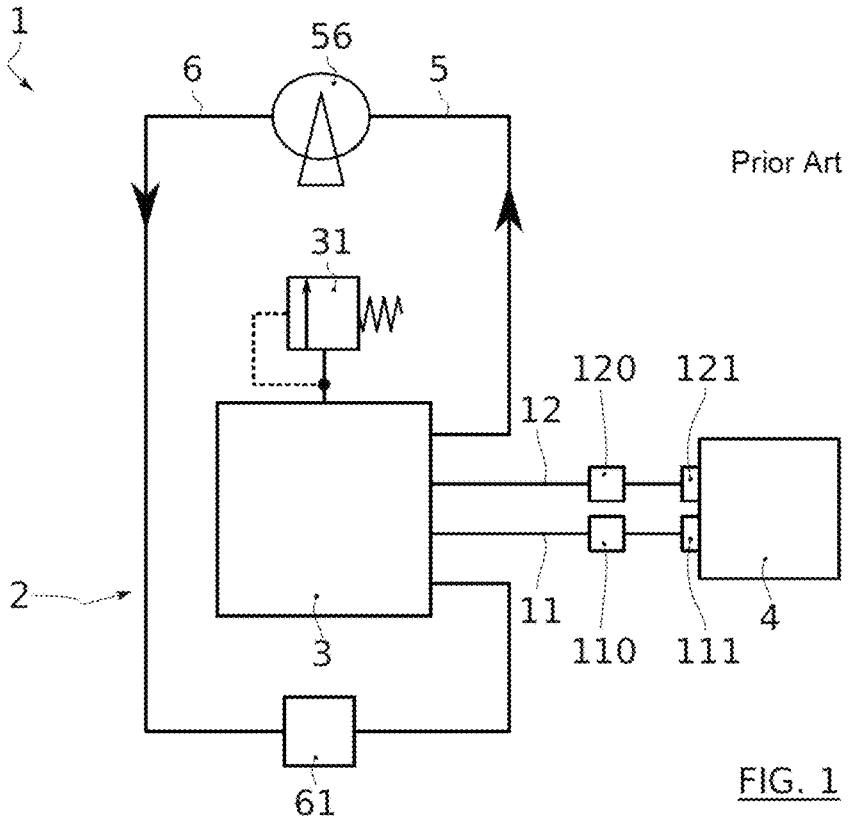
FIG. 1 shows a conventional mechanical semi-closed recycler coming from the prior art.

The invention according to the first aspect thereof comprises in particular the optional features below which could be used in association or alternatively:

- According to an embodiment, the at least one sensor is a ventilatory frequency sensor.
- According to an embodiment, the ventilatory frequency sensor is positioned on a portion of the breathing loop situated between the inlet of the mouthpiece and the outlet of the breathing bag. This makes it possible to reduce the humidity to which the sensor is exposed. Indeed, if it was arranged between the mouthpiece and the recycling chamber, or in the latter, the sensor would be subjected to a higher humidity. It has been proved to be that the reliability of these sensors is degraded by the presence of too high humidity. This embodiment thus makes it possible to also improve the reliability, and consequently, the safety of the apparatus according to the invention.
- According to an example, the at least one diving condition parameter is a physiological parameter of the diver. This physiological parameter can be, for example, the ventilatory frequency of the diver and/or the cardiac frequency thereof and/or the saturation/oxygen rate in the blood of the diver. Thus, the at least one diving condition sensor is configured to measure the ventilatory frequency of the diver and/or the cardiac frequency thereof and/or the saturation/oxygen rate in the blood of the diver. This is a direct measurement. This parameter or an item of data relating to this parameter is then sent to the electronic control module which controls the gas flow regulator.

According to an embodiment, the apparatus further comprises a demand regulator equipping an additional duct from among said plurality of ducts. Said demand regulator is configured to deliver an additional fresh gas input to the breathing bag.

According to an embodiment, a manual injector can be substituted for the demand regulator to deliver to the breathing bag, the additional fresh gas input coming from the at least one gas tank.

According to an embodiment, the first and the second ducts supplying two separate inlets of the breathing bag. According to an alternative embodiment, the first and the second ducts supply one same inlet of the breathing bag. For example, a Y-shaped duct makes it possible to collect the fresh gas inputs of the first and second nozzles and to supply one single inlet of the breathing bag. This alternative embodiment makes it possible to reduce the number of inlets of the breathing bag and the number of ducts. It thus simplifies the apparatus and improves the robustness thereof.

According to an embodiment, the first and the second ducts are supplied by two separate outlets of the breathing bag. According to an alternative embodiment, the first and the second ducts are supplied by one same outlet of the breathing bag. For example, a Y-shaped duct makes it possible to supply the first and the second ones. This alternative embodiment makes it possible to reduce the number of outlets of the tank and the number of ducts. It thus simplifies the apparatus and improves the robustness thereof.

Likewise, the additional duct equipped with the optional demand regulator, when it is present, can optionally be connected to the same inlet and/or the same outlet that at least one from among the first and the second duct.

According to an embodiment, the recycling chamber comprises a filtration device such as a soda lime cartridge.

According to an embodiment, the mouthpiece is configured to engage with the mouth of the diver.

According to an embodiment, the mouthpiece is presented in the form of a facemask taking both the mouth and the nose of the diver.

According to an embodiment, the apparatus comprises a physiological sensor configured to measure at least one physiological parameter of the diver and a depth sensor to measure the pressure of the water surrounding said apparatus, and the apparatus is configured to control the gas flow regulator so as to make the variable volume flow vary, at least according to the physiological parameter of the diver and of the pressure.

According to an embodiment, the gas flow regulator comprises a second nozzle having a variable cross-section so as to deliver the second variable volume flow input.

According to an embodiment alternative to the preceding embodiment, the gas flow regulator comprises a valve with an intermittent opening and a nozzle having a fixed cross-section, said nozzle being coupled with said valve so as to deliver the second variable volume flow and preferably variable mass flow input.

According to an embodiment, the apparatus is configured such that the variable volume flow and preferably, the variable mass flow delivered by the gas flow regulator is respectively less than or equal to the constant volume flow and preferably to the constant mass flow delivered by the fixed nozzle.

This configuration makes it possible to deliver at least half of the total volume flow by the first nozzle with a constant volume flow, and at most half of the total volume flow by the second nozzle with a variable volume flow. A gas saving of 50% is thus advantageously possible in situation of minimum force of the diver (static dive) while keeping an acceptable fresh air input for the diver in case of malfunction of the second nozzle. This solution thus offers an improved safety level since even in case of failure of the nozzle with a variable volume flow, the breathing bag is supplied with sufficient fresh gas such that the diver is not in situation of danger. It can thus, for example, end the dive thereof with a satisfactory comfort level, or regain the surface, or also be directed towards other divers.

According to an embodiment, the apparatus is configured such that the constant volume flow $D_{1v}$ delivered by the fixed nozzle and the variable volume flow $D_{2V}$ delivered by the gas flow regulator are such that $k_1*(D_{1v}+D_{2v})\leq D_{2v}\leq k_2*(D_{1v}+D_{2v})$, with $k_1=0.1$ and $k_{2=0.9}$, preferably with $k_1=0.2$ and $k_{2=0.8}$, and preferably with $k_1=0.3$ and $k_2=0.7$.

According to an embodiment, the fixed nozzle is configured to deliver the first fresh gas input from a first pressurised gas tank and the gas flow regulator is configured to deliver the second fresh gas input from a second pressurised gas tank.

This configuration advantageously makes it possible to separate the gas supply sources, which reduces the probability of occurrence of a total rupture of gas supply (case of simultaneous breakdowns on each of the first and second nozzles). This embodiment thus makes it possible to also improve the reliability, and consequently, the safety of the apparatus according to the invention.

According to an embodiment, the apparatus comprises the at least one gas tank.

According to an embodiment, the gas flow regulator is formed of at least and preferably only:

- a fixed nozzle configured to deliver at a constant volume flow and preferably at a constant mass flow, a first fresh gas input to the breathing bag,
- a solenoid valve configured to make the flow of said fresh gas input vary over time so as to deliver at a variable volume flow and preferably at a variable mass flow, the second fresh gas input to the breathing bag.

According to an embodiment, the solenoid valve and the fixed nozzle of the gas flow regulator are connected in series.

Below in the description, when it is indicated that a member A is directly connected to a member B, this means that there are no other members between A and B, except for indication on the contrary.

According to an embodiment, the outlet of the mouthpiece is directly connected to the inlet of the recycling chamber.

According to an embodiment, the outlet of the recycling chamber is directly connected to an inlet of the breathing bag.

According to an embodiment, an outlet of the breathing bag is directly connected to an inlet of the mouthpiece, except for at least one sensor configured to measure the diving condition parameter used to control the gas flow regulator.

According to an embodiment, a first duct directly connects a fresh gas tank to the breathing bag, except for the fixed nozzle which is arranged on this first duct.

According to an embodiment, a second duct directly connects a fresh gas tank to the breathing bag, except for the gas flow regulator which is arranged on this second duct.

According to an embodiment, a third duct, which is only optional, directly connects the fresh gas tank to the breathing bag, except for the demand regulator which is arranged on this third duct.

The invention according to the second aspect thereof comprises in particular the optional features below which could be used in association or alternatively:

According to an embodiment, the at least one diving condition sensor is a physiological sensor.

According to an embodiment, the physiological sensor is a ventilatory frequency sensor.

According to an embodiment, the ventilatory frequency sensor is configured to be positioned on a breathing loop between the inlet of the mouthpiece and the outlet of the breathing bag.

According to an embodiment, the kit further comprises a depth sensor configured to be connected to the electronic control module so as to make it possible for the electronic control module to control said variable volume flow according to at least one item of data of said depth sensor. Below in the description and the claims, the following meanings are given:

sonic nozzle: the sonic nozzle is a calibrated orifice wherein the flow speed of the gas is greater than or equal to the sonic speed of this gas to the right of the minimum passage cross-section of the orifice (sonic or supersonic flow).

volume flow: the volume flow $D_v$ of a gas passing through an orifice or a nozzle of cross-section S at a speed v is: $D_v = v.S$. In the case of a subsonic flow, this flow $D_v$ varies according to the pressure of the gas upstream from the nozzle and of the pressure of the gas downstream from the nozzle. In the case of a supersonic flow, this flow $D_v$ varies according only to the pressure of the gas upstream from the sonic nozzle. The volume flow $D_v$ is expressed in L/min below.

constant volume flow: a gas flowing through a sonic nozzle of fixed cross-section S at the sonic speed has a constant volume flow for a constant pressure of the gas upstream from the sonic nozzle.

mass flow: the mass flow $D_M$ of a gas passing through an orifice or a nozzle of cross-section S at a speed v is: $D_M = \rho.v.S$, where ρ is the density of the gas.

constant mass flow: a gas flowing through a nozzle of fixed cross-section S at the sonic speed has a constant mass flow, if the density of this gas is constant. In particular, a gas delivered at constant pressure upstream from the sonic nozzle has such a constant mass flow.

Below, a constant mass or volume flow is also called sonic stream.

Constant flow is qualified as a flow which does not vary over time (over a period of observation greater than 1 minute, preferably greater than five minutes and preferably comprised between a few minutes and a few tens of minutes) of more or less 10% and preferably more or less 5% and preferably more or less 2%.

air equivalent depth: depth indicated on decompression practice relating to mixtures of breathing gases containing nitrogen and oxygen in proportions different from those of air, known by the name of nitrox.

Below, the terms "orifice" and "nozzle" are used as synonyms. The terms "flow" and "stream" are also used as synonyms.

The terms "gas recycling breathing apparatus", "rebreather" and "recycler" are used as synonyms.

Below, fresh gas is a gas containing oxygen and which has not been recycled by trapping the $CO_2$ exhaled by the user. Thus, the term "fresh" gas is extended by opposing the term "recycled" gas, recycled gas being the gas delivered by a recycling chamber after trapping the $CO_2$ exhaled by the user. The fresh gas typically comes from a gas cylinder embarked by the diver. The fresh gas can be fresh air, or a mixture comprising proportions of nitrogen and oxygen different from those of air, such as nitrox, or also a mixture comprising nitrogen, helium and oxygen such as trimix.

In particular, "fresh air" and "fresh gas" are used as synonyms and can also be extended from "nitrox" and "trimix" or other variants of trimix-type gaseous mixtures, such as heliox, heliair, triox for example. Typically, it can be a superoxygenated gas, i.e. a mixture containing a percentage of oxygen greater than 21% by volume, for example equal to 30%, to 40%, to 50% or to 60%.

Below in the description and the claims, by "variable nozzle", this means a device for regulating a gas flow. For example, a nozzle having an opening of variable and/or adjustable cross-section forms such a device. A nozzle having an opening of fixed cross-section associated with an intermittent valve also forms such a device. This device can be simply called "gas flow regulator".

The present invention will now be described through a preferred, but non-limiting embodiment. In reference to FIGS. 2 and 3, a first embodiment of the invention is a semi-closed circuit gas recycling scuba diving breathing apparatus 1 comprising a breathing loop 2, a breathing bag 3. The apparatus is configured to be fluidically connected to at least one gas tank 4.

The breathing loop 2 comprises a first side called inhalation side 5 and a second side called exhalation side 6.

The inhalation side 5 comprises a duct extending from an outlet of the breathing bag 3 to an inlet of the mouthpiece 56 or of a mask intended for the diver 10 and makes it possible to convey the air inhaled by the diver 10. The mouthpiece can be a mouthpiece inserted partially in the mouth of the diver or be integrated to a facemask taking both the mouth and the nose of the diver.

The exhalation side 6 comprises a duct extending from an outlet of the mouthpiece 56 or from the mask to an inlet of the breathing bag 3 and makes it possible to convey the air exhaled by the diver 10.

The exhalation side 6 comprises in particular a recycling chamber 61 capable of receiving a device for filtering the exhaled air, such as a soda lime cartridge. Such a filtration device is configured to trap the carbon dioxide present in the exhaled air, and to let a filtered or purified portion of the exhaled air. This portion also called recycled air, is then reinjected into the breathing bag 3. The recycling chamber 61 has an inlet coupled with the outlet of the mouthpiece 56 or of the mask and an outlet coupled with the inlet of the breathing bag 3.

The breathing bag 3 is therefore partially supplied by the recycled air.

The supply of fresh air from the breathing bag 3 is done preferably mainly by way of a first duct 12 and of a second duct 13 extending between the at least one gas tank 4 and the breathing bag 3.

The breathing bag 3 is therefore advantageously supplied by a main double injection of gas in order to optimise the gas consumption of the diver 10 and the safety of the dive. These advantages are explained below.

The first duct 12 can comprise a first nozzle 120 having preferably a fixed cross-section. A first regulator 121 at the level of an outlet of the at least one gas tank 4, connected to this first duct 12 upstream from the first nozzle, called fixed nozzle 120, is configured to deliver a gas at the inlet of this fixed nozzle 120. This first regulator 121 corresponds, for example, to a "first stage" type regulator that is usually found on diving cylinders. This type of regulator makes it possible typically to expand a gas of 200 bars to 10 or 15 bars. This type of regulator is generally served with hydrostatic pressure of the surrounding medium, so as to deliver a relative pressure, for example 15 bars relative to the surrounding hydrostatic pressure.

According to a preferred embodiment, this first regulator 121 is configured to deliver a gas at a constant pressure, for example 15 bars, at the inlet of the fixed nozzle 120. In this case, this first regulator 121 is not served with the surrounding hydrostatic pressure, so as to deliver an absolute pressure, for example 15 bars, whatever the surrounding hydrostatic pressure. This makes it possible to deliver the gas having a constant density at the inlet of the fixed nozzle 120. The quantity of oxygen contained in this gas is therefore constant, whatever the hydrostatic pressure. The fixed nozzle 120 is configured to deliver, at the outlet, the gas at an ambient pressure so as to supply the breathing bag 3 by a sonic gas stream, with a constant volume gas flow $D_{1v}$, and preferably with a constant gas mass flow Dim. In the non-limiting example illustrated in FIG. 2, the inlet of the breathing bag 3 supplied by the duct 12 carrying the fixed nozzle 120 is referenced 122.

The constant gas volume flow $D_{1v}$ can be comprised between 0 and 40 litres per minute, preferably between 0 and 30 litres per minute, and even more preferably, between 0 and 20 litres per minute.

The second duct 13 can comprise a gas flow regulator 130. The gas flow regulator 130 preferably comprises:

- Either a second nozzle preferably having a variable cross-section.
- Or a fixed nozzle 136, i.e. a nozzle with fixed cross-section, connected to a valve 155 enabling the passage of the gas intermittently. It can, for example, be a solenoid valve.
- Or a combination of a solenoid valve and a valve 155 enabling the passage of the gas intermittently.

A second regulator 131 at the level of the at least one gas tank 4, connected to this second duct 13 upstream from the gas flow regulator 130, is configured to deliver gas at the inlet of this gas flow regulator 130. This second regulator 131 can be a "first stage"-type regulator. Advantageously, and similarly to the operation of the first regulator 121 detailed above, this second regulator 131 is configured to deliver gas at a constant pressure, for example 15 bars, at the inlet of the gas flow regulator 130.

According to an embodiment, the first and second regulators 121, 131 can be one single and same regulator, so as to simplify the system and make it more robust. The connector between this regulator and the first and second ducts 12, 13 can thus comprise a diversion so as to supply each of the two ducts 12, 13.

The gas flow regulator 130 is configured to deliver at the outlet, the gas supplying the breathing bag 3 with a variable gas volume flow $D_{2v}$, and preferably with a variable gas mass flow $D_{2M}$. In the non-limiting example illustrated in FIG. 2, the inlet of the breathing bag supplied by the duct 13 carrying the gas flow regulator 130 is referenced 132.

The variable volume flow of gas $D_{2v}$ is such that $D_{2min} \leq D_{2v} \leq D_{2max}$.

For example, the variable volume flow of gas $D_{2v}$ can be comprised between 0 and 40 litres per minute, preferably between 0 and 30 litres per minute and even more preferably between 0 and 20 litres per minute.

According to this example of an embodiment, the gas flow regulator 130 continually supplies the breathing bag 3 at least for $D_{2v} > D_{2min}$, without interrupting the fresh gas input.

Figure 4:
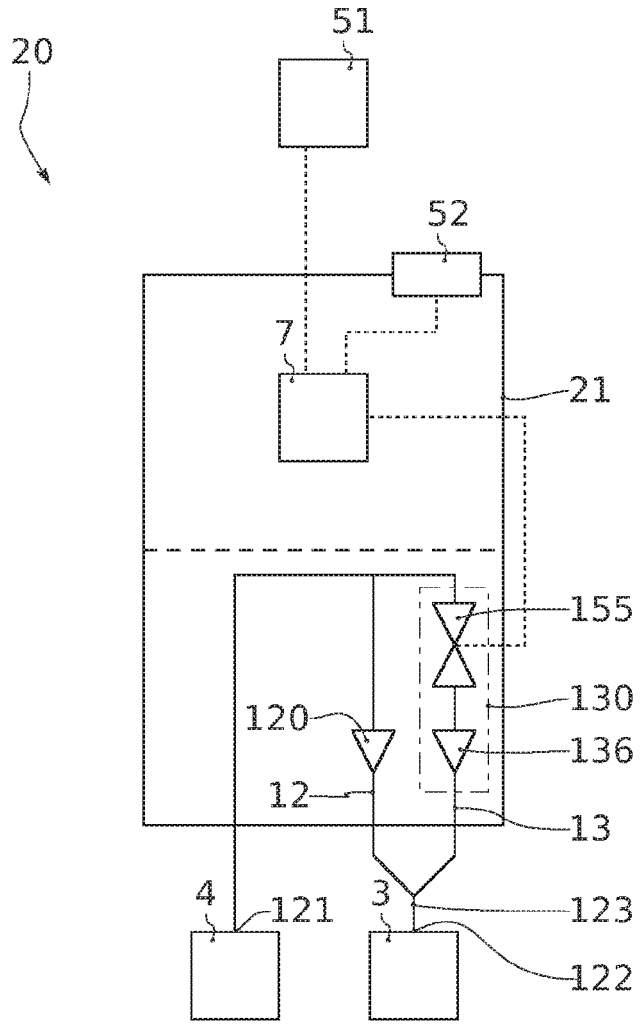
FIG. 4 illustrates an example of a kit according to the invention.

According to an alternative embodiment, the first 12 and second 13 ducts are supplied by one same outlet 121 of the gas tank 4, as illustrated in FIG. 4.

According to an alternative embodiment, the first 12 and second 13 ducts supplying one same inlet 122 of the breathing bag 3, as illustrated in FIG. 4. For this, the first 12 and second 13 ducts are connected; for example Y-shaped, to a common duct 123.

These embodiments make it possible to simplify and to improve the robustness of the apparatus.

According to an embodiment, the gas flow regulator 130 can be constituted of a nozzle with variable cross-section called variable nozzle.

According to another embodiment, the gas flow regulator 130 can be constituted by the association of a fixed nozzle 136 of constant cross-section and of a valve 155 or solenoid valve with an intermittent opening, occasionally interrupting the fresh gas input, so as to make the volume flow $D_{2v}$ vary. In this configuration, the flow $D_{2v}$ only takes the values 0 and $D_{2max}$. This second fresh gas input can this be flowed at sonic stream, which advantageously makes it possible to precisely evaluate the quantity of oxygen actually delivered. The average fresh gas input coming from this second input therefore varies according to a cut-off frequency of the solenoid valve, for example. This configuration also makes it possible to reduce the cost of the system. This alternative embodiment is illustrated in FIG. 4.

Below, the description makes reference to the embodiment wherein the gas flow regulator 130 comprises a nozzle with variable cross-section. However, all the embodiments, all the features and advantages described below can be combined with the embodiment wherein the gas flow regulator 130 comprises a fixed or variable nozzle 136 connected to an intermittent valve 155 such as a solenoid valve. The numeric reference 130 is therefore used for the gas flow regulator 130, whatever the embodiment thereof and the expression "variable nozzle 130" can be replaced by the expression "gas flow regulator 130".

According to an operational embodiment, the breathing bag 3 can be supplied with fresh air by way of an additional duct 11 extending between the at least one gas tank 4 and the breathing bag 3.

This additional duct 11 can be configured to deliver an additional fresh gas input via a demand regulator 110. This demand regulator 110 can be controlled manually by the diver 10 (it can thus be qualified as an injector) as needed, and/or can be triggered automatically during a quick descent in order to deliver complementary fresh air in the breathing bag 3. Such a demand regulator 110 is perfectly conventional and widely known in the field of diving. It typically corresponds to a "second stage"-type regulator that is found on open circuit (OC) breathing apparatuses, the air inhalation being connected to the breathing bag in the scope of the invention. According to an alternative embodiment, the additional fresh gas input is delivered via a manual injector alone or coupled with a demand regulator 110.

The reference 110 corresponds either to a demand regulator, or to a demand regulator coupled with a manual injector, or to only a manual injector.

As with the first duct 12 and the second duct 13, the additional duct 11 comprises a regulator 111 at the level of an outlet of the at least one gas tank 4. The regulator 111 is configured to deliver a gas at an inlet of the demand regulator 110. This regulator 111 corresponds, for example, to a "first stage" type regulator that is usually found on diving cylinders. This type of regulator makes it possible typically to expand a gas of 200 bars to 10 or 15 bars.

Advantageously, the breathing bag 3 is suppled continually by way of the fixed nozzle 120, and variably by way of the variable nozzle 130. The total volume flow $D_N$ of gas delivered to the breathing bag 3 is written $D_N=D_{1v}+D_{2v}$.

Advantageously, the variation of the flow $D_{2v}$ of the variable nozzle 130 depends on a physiological need of the diver 10.

According to a preferred embodiment, the breathing apparatus 1 comprises an electronic control module 7 and a first sensor 51 called physiological sensor, configured to measure a physiological parameter of the diver 10.

The physiological sensor 51 is preferably a breathing frequency sensor. It can be situated on the inhalation side 5 of the breathing loop 2, and is preferably configured to minimise the load loss in the breathing loop 2. Such a sensor can, for example, be based on the measurement of a movement speed of a heated gas bubble. Thus, the sensor directly measures the breathing frequency. This sensor does not depend on a mechanical device which enables or not the gas input. Thus, the sensor according to the invention is not a demand regulator which enables the gas input. The precision and the safety of the apparatus are greatly improved.

The physiological parameter measured, in this example, the breathing frequency measured, can thus be sent to the electronic control module 7 in real time. The electronic control module 7 is configured to adjust the variable flow $D_{2v}$ by way of a microcontroller controlling the variable nozzle 130 according to at least the physiological parameter measured, in this example of the breathing frequency measured. Thus, the variable nozzle 130 is controlled by the apparatus 1 and more specifically by a microcontroller.

The variable nozzle 130 is configured to remain open if it is no longer supplied with energy, for example if the electronic module is not activated (ON/OFF button not actuated), or if the battery is discharged, or also in case of failure of the electronic control module 7 and/or of the microcontroller. This makes it possible to also reinforce the safety of the breathing apparatus. According to an alternative possibility, the physiological sensor 51 can be a cardiac rhythm sensor. In this case, the sensor is, for example, fixed on the thorax or on the wrist of the diver. According to an alternative possibility, the physiological sensor 51 can be a blood oxygen saturation sensor. In this case, the sensor is, for example, fixed on the thorax or on the wrist of the diver.

According to another possibility, the breathing apparatus 1 can comprise several identical sensors to increase the reliability of the assembly by overlapping.

According to another possibility, the breathing apparatus 1 can comprise several sensors of different types (for example, breathing frequency sensor and cardiac rhythm sensor). This makes it possible to evaluate more specifically the quantity of fresh air to be supplied to the breathing bag. This also makes it possible to also reinforce the safety of the breathing apparatus.

Thus, the at least one diving condition sensor is configured to measure at least one from among the following parameters: the ventilatory frequency of the diver, the cardiac frequency thereof, the saturation/the oxygen rate in the blood of the diver. This is a direct measurement. This parameter of an item of data relating to this parameter is then sent to the electronic control module which controls the gas flow regulator.

According to an embodiment, the total flow $D_N$ of gas therefore depends on the breathing frequency measured, by way of the variable nozzle 130 delivering $D_{2v}$, and thus responds to an oxygen need of the diver 10.

The variable flow $D_{2v}$ is preferably zero for a breathing frequency measured below a first threshold $RV_1$ corresponding to a minimum force of the diver 10. Statistically, the breathing frequency of a diver is less than 10 breaths per minute during situations of minimum force, such as a static dive or during a decompression stop.

Advantageously, for a measured breathing frequency less than $RV_1$ with, for example $RV_1$=10 breaths per minute, the variable flow $D_{2v}$ can be electronically adjusted such that $D_{2v}$=0 L/min.

In this case, only the first nozzle 120 with a constant volume flow supplies the breathing bag 3 with gas ($D_N=D_{1v}$). A gas saving can thus be achieved and the duration of the dive is extended. Moreover, the breathing comfort of a diver 10 breathing in the apparats 1 becomes greater than a diver breathing in a conventional recycler comprising a breathing bag supplied only constantly, said breathing bag thus being oversupplied with gas in such a situation of minimum force.

The variable flow $D_{2v}$ is preferably maximum for a breathing frequency measured above a second threshold $RV_2$ corresponding to an intense force of the diver 10. Statistically, the breathing frequency of a diver is greater than 20 breaths per minute during situations of intense force, such as a dive into the current or when working.

The breathing comfort of a diver 10 breathing in the apparatus 1 can also be greater than that of a diver breathing in a conventional recycler comprising a breathing bag supplied constantly only, said breathing bag thus being undersupplied with gas in such a situation of intense force.

For a measured breathing frequency comprised between $RV_1$ and $RV_2$, the variable flow $D_{2v}$ can be equal to an average flow $(D_{2min}+D_{2max})/2$, or can vary continually according to the measured breathing frequency.

According to a possibility, at least half of the total volume flow $D_N$ can be delivered by the first nozzle 120 with a constant volume flow $D_{1v}$, and at most half the total volume flow $D_N$ can be delivered by the second nozzle 130 with a variable volume flow $D_{2v}$, such that $0 \leq D_{2v} \leq D_{1v}$ and $D_{2max}=D_{1v}$.

A gas saving of 50% is thus advantageously possible in a situation of minimum force of the diver 10. This compromise also makes it possible to keep an acceptable fresh air input for the diver 10 in case of malfunction of the second nozzle 130.

This double fresh air supply of the breathing bag 3 by the fixed nozzle 120 and by the variable nozzle 130 thus makes it possible to optimise the consumption of gas by reducing wastage and by increasing the comfort of the diver 10 during the dive.

Another advantage is the reduction of the quantity of gas rejected by the pressure relief valve 31 of the breathing bag 3, which increases the visual and acoustic discretion during the dive.

According to an advantageous possibility, additionally or alternatively to the physiological sensor, the apparatus 1 comprises a depth sensor 52 or surrounding pressure connected to the electronic control module 7. The electronic control module 7 can be configured to adjust the total volume flow $D_N$ according to the depth measured $P_{mes}$ by the depth sensor 52. This adjustment of $D_N$ is made by way of the variable nozzle 130 making it possible for a variation of $D_{2v}$.

In particular, the total flow $D_N$ can be reduced in a so-called deep diving zone, for a depth greater than a depth limit $P_{lim}$ for example equal to 18 m. The partial oxygen pressure $PO_2$ in the gas increases with the depth (Dalton's law), such that from the depth limit $P_{lim}$, a decrease of the total flow $D_N$ can be made to compensate for the increase of $PO_2$. This decrease of the total flow $D_N$ according to the depth measured, for $P_{mes}>P_{lim}$, also makes it possible to save gas.

This decrease of the total flow $D_N$ leading to a decrease of $PO_2$ furthermore makes it possible to limit the risk of hyperoxic crisis, which becomes significant for a $PO_2>1.6$ bar.

Through safety, the electronic control module 7 is preferably configured to limit the decrease of the total flow $D_N$ so as to conserve a partial oxygen pressure $PO_2$ greater than 1 bar and/or greater than a partial oxygen pressure with the air equivalent depth. In this way, the diver 10 still has the possibility of following an Air decompression stop when coming back up to the surface.

The flow $D_{1v}$ is preferably delivered by way of only mechanical elements, such as the first constant pressure regulator and the fixed nozzle 120. The flow $D_{1v}$ is therefore controlled purely mechanically.

The flow $D_{2v}$ is preferably electronically controlled by the electronic control module 7.

The double gas injection in the breathing bag 3 is done therefore preferably by a so-called mechanical injection and by a so-called electronic injection.

According to a possibility, the mechanical injection and electronic injection proportion can be selected so as to optimise the general operation of the breathing apparatus 1.

This choice can result, for example, from a risk analysis.

The flow ratio $L=D_{2v}/D_N$ can thus be adjusted between 0 and 1 according to the desired mechanical injection and electronic injection proportion.

For L=0, the operation of the apparatus 1 corresponds to that of a conventional semi-closed mechanical recycler of which the whole injection is regulated by a fixed nozzle.

For L=1, the operation of the apparatus 1 corresponds to a recycler of which the whole flow is electronically controlled.

The risk analysis relates to a malfunction of the apparatus 1 in case of damage at the level of the flows $D_{1v}$ and/or $D_{2v}$ shows that:

In the case where the fixed nozzle 120 operates normally and the variable nozzle 130 does not operate and remains open (case of damage no. 1), the injection is constant and has a maximum total flow $D_N=D_{1v}+D_{2max}$, The apparatus 1 thus operates similarly to a conventional mechanical semi-closed recycler.

In the case where the fixed nozzle 120 operates normally and the variable nozzle 130 does not operate and remains closed (case of damage no. 2), the injection is constant and has a minimum total flow $D_N=D_{1v}$. The diver 10 is not in a situation of danger and can, for example, end their dive, or come back up to the surface, or also direct themselves towards other divers, by minimising their forces.

The choice of the ratio L can make it possible to favour a gas input by mechanical injection with the flow $D_{1v}$, rather than the gas input by electronic injection with the flow $D_{2v}$. For L<0.5, the diver 10 can continue their dive with a satisfactory level of comfort in this case of damage no. 2.

In the case where the fixed nozzle 120 does not operate and the variable nozzle 130 operates normally (case of damage no. 3), the injection is variable and has a total flow $D_N=D_{2v}$.

The choice of the ratio L can make it possible to favour a gas input by electronic injection with the flow $D_{2v}$, rather than the gas input by mechanical injection with the flow $D_{1v}$. For L>0.5, the diver 10 can continue their dive with a satisfactory level of comfort in this case of damage no. 3. The probability of occurrence in this case of damage no. 3 is identical to the probability of occurrence of a nozzle fitted on a conventional mechanical semi-closed apparatus.

In the case where the fixed nozzle 120 does not operate and the variable nozzle 130 does not operate and remains closed (case of damage no. 4), there is no longer any main injection and $D_N=0$.

This case of damage no. 4 must be managed by the diver 10 in the same way as with a conventional mechanical semi-closed recycler.

According to an advantageous possibility, the fixed nozzle 120 is connected to a first gas tank and the variable nozzle 130 is connected to a second gas tank, such that the supply sources of the two nozzles are separated. The probability of occurrence of the case of damage no. 4 is thus reduced.

The probability of occurrence of a critical situation for such an apparatus 1 is thus reduced vis-á-vis a conventional semi-closed apparatus. This solution therefore offers an improved safety level.

The injection $D_N$ can furthermore be completed as needed thanks to the demand regulator 110 on the duct 11, for example.

This complementary injection by the duct 11 preferably delivers the same gas as the main injection by the nozzles. The triggering of the demand regulator 110 can be done manually by the diver 10, and/or automatically, for example, during a quick descent of the diver 10. This makes it possible to avoid the breathing bag 3 from retracting under the effect of increasing the ambient hydrostatic pressure, the fixed and variable nozzles delivering a quantity of gas which is not enough to quickly compensate for the increasing of the ambient hydrostatic pressure.

This demand regulator 110 therefore increases the comfort of the diver and makes it possible for them to achieve quick descents, but is not essential.

Figure 2:
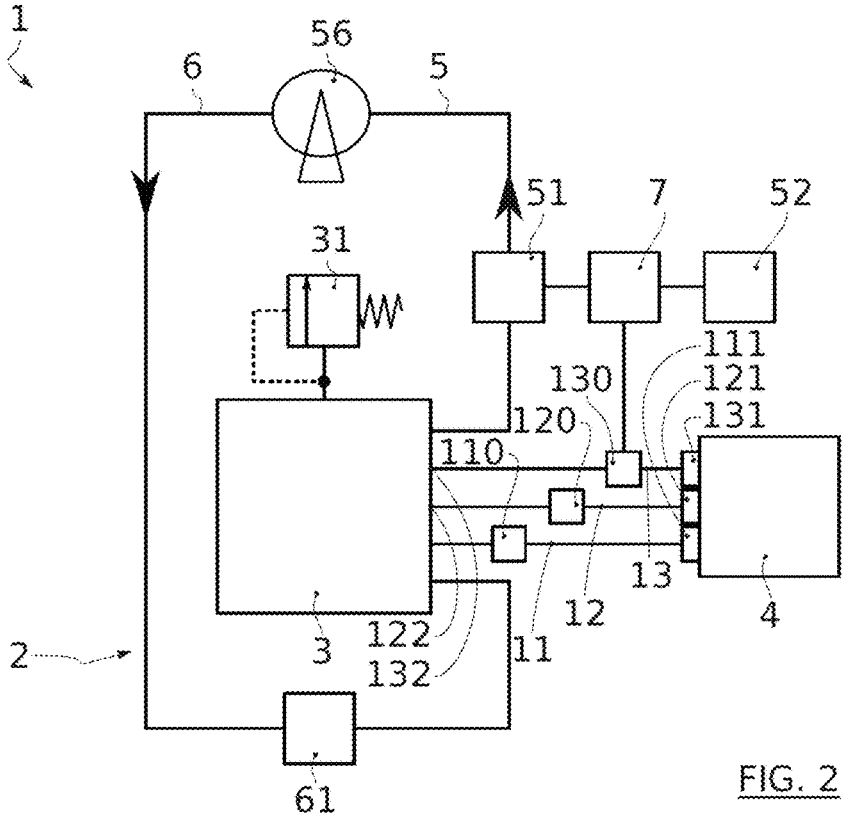
FIG. 2 shows a semi-closed recycler according to a non-limiting embodiment of the invention.
Figure 3:
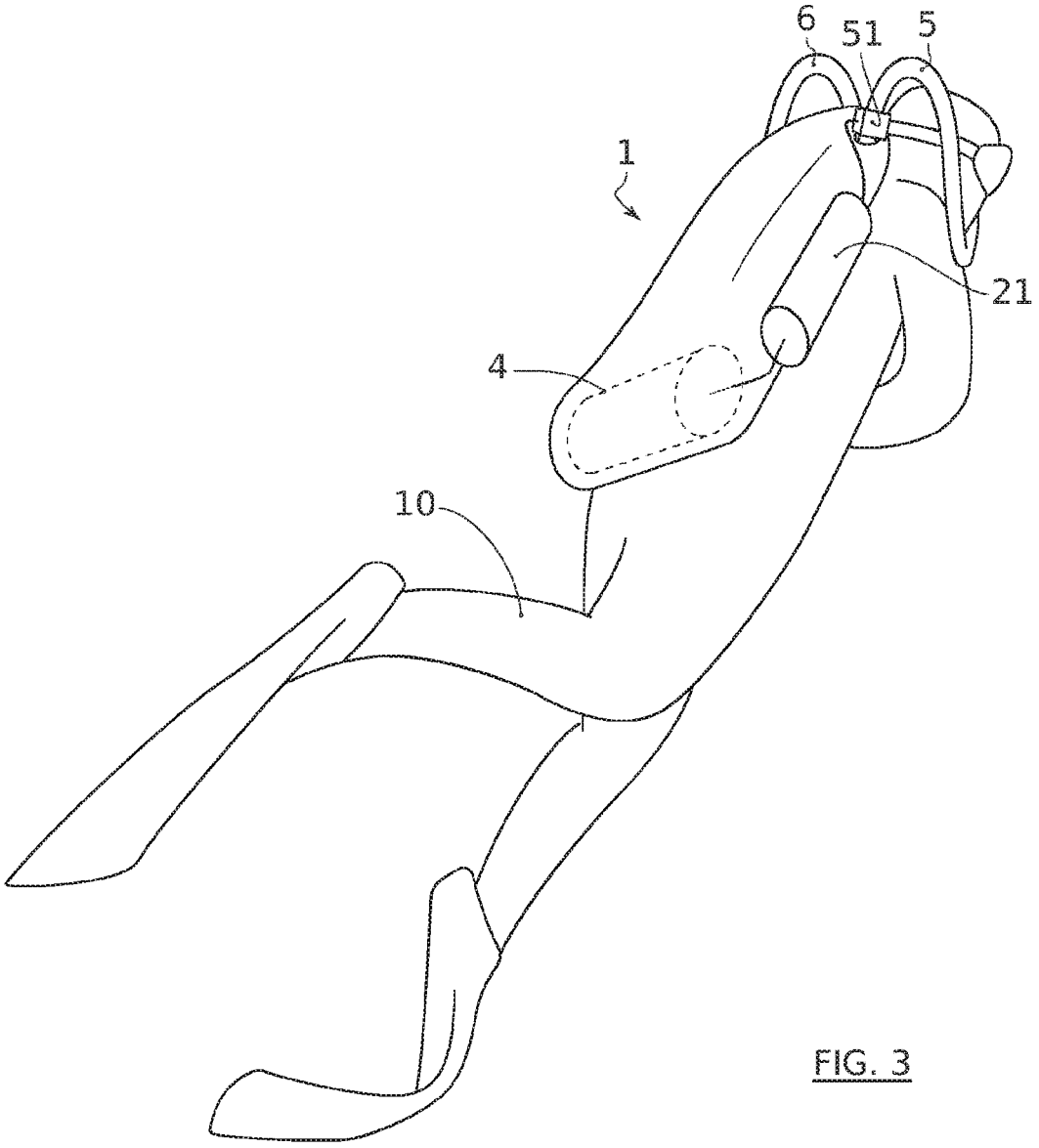
FIG. 3 illustrates a semi-closed recycler according to an embodiment of the invention carried by a diver.

As illustrated in FIG. 2, it will be noted that the first duct 12 makes it possible for the passage of the gas from the gas tank 4 to the breathing bag 3, by only passing through the first nozzle 120 with a constant volume flow. Preferably, this duct 12 only includes the first nozzle 120 with a constant volume flow. In particular, this duct 12 does not include any demand regulator. The gas passing through the first nozzle 120 with a constant volume flow does not pass through a demand regulator before reaching the breathing bag 3. This makes it possible to considerably improve the safety of the apparatus.

The breathing bag 3 also preferably comprises a pressure relief valve 31 making it possible to remove the excess gas in the breathing loop 2.

A second aspect of the invention relates to an adaptable kit 20 on a conventional mechanical semi-closed recycler. Typically, this kit 20 can be mounted on an apparatus such as that illustrated in FIG. 1.

In reference to FIG. 4, this kit 20 comprises at least one so-called variable nozzle 130, configured to deliver a variable volume flow of gas $D_{2v}$, a sensor 51, 52 configured to measure a depth or a physiological parameter of the diver and an electronic control module 7 configured to make the flow $D_{2v}$ of the variable nozzle 130 vary according to at least one item of data of the sensor 51, 52.

The variable flow nozzle 130, also called gas flow regulator 130, can be formed by a solenoid valve 155 associated with a constant flow nozzle 136. According to an example, such a nozzle 136 is, for example, similar to a sonic nozzle 120. The variable nozzle 130 can be connected on an auxiliary duct supplied separately or comprised in the kit 20. This auxiliary duct connects the breathing bag 3 and at least one gas tank 4 of the conventional mechanical semi-closed recycler, so as to deliver an auxiliary fresh gas input with a variable volume flow $D_{2v}$.

A Y-shaped connection 123 at the inlet and/or at the outlet of the nozzles 120 and 130 or of the ducts 12, 13 equipped with the nozzles 120, 130 can make it possible to simplify the connector and to improve the robustness of the apparatus. This makes it possible, for example, to only have one single inlet 122 on the breathing bag to collect the inputs from the nozzles 120 and 130. These Y-shaped connections can be supplied separately or integrated in the kit 20.

Preferably, it will be noted that also in this example, the duct 12 enables a supply of the breathing bag 3 by the gas tank 4 by only passing through the first nozzle 120 with a constant volume flow. In particular, the gas coming from the gas tank 4 does not pass through another member such as a demand regulator to reach the breathing bag 3 by passing through the duct 12 and the first nozzles 120 with a constant volume flow.

The physiological sensor 51 is preferably a ventilatory frequency sensor, and can be connected on the breathing loop 2 of the conventional mechanical semi-closed recycler, between the breathing bag 3 and the mouthpiece 56 intended for the diver.

In addition to the physiological sensor 51 or alternatively to the physiological sensor 51, the kit 20 comprises a depth sensor 52 and the electronic control module 7 is configured to make the flow $D_{2v}$ of the variable nozzle 130 vary according to at least one item of data of the depth sensor 52.

The depth sensor 52 is preferably integrated in a sealed chamber 21. This makes it possible to reduce the bulk of the kit 20 and to improve the handling of this kit 20 by the user.

This kit 20 advantageously makes it possible and at a lesser cost, to transform the conventional mechanical semi-closed recycler into a breathing apparatus 1 according to the first aspect of the invention.

As emerges clearly from the detailed description above, the invention proposes a breathing apparatus and a kit 20 for a robust and particularly reliable breathing apparatus. The invention thus makes it possible to considerably improve the safety and the comfort of the diver. The invention furthermore makes it possible to extend the duration of the dive compared with a standard recycler.

The invention is not limited to the embodiments described above, but extends to all embodiments falling under the scope of the claims.

The invention claimed is:

1. A semi-closed circuit gas recycling scuba diving breathing apparatus intended to be carried by a diver, comprising a breathing loop intended to be connected to at least one gas tank, the breathing loop comprising:

at least one mouthpiece intended for the diver and making it possible for the diver to breathe in the breathing loop, at least one recycling chamber connected to an outlet of a nozzle and intended to recycle at least some of a gas exhaled by the diver so as to supply a recycled gas, said at least one chamber being configured to receive a device for filtering the exhaled gas, and at least one breathing bag having an outlet connected to an inlet of the mouthpiece, an inlet connected to an outlet of the at least one recycling chamber and at least one inlet intended to be connected to at least one outlet of the at least one gas tank, the at least one breathing bag being configured to make it possible for a mixing within it of the recycled gas coming from the at least one recycling chamber and at least one fresh gas input, coming from the at least one gas tank, the apparatus comprising a plurality of ducts making it possible for connections in parallel between at least one inlet of the at least one breathing bag and at least one gas tank, the apparatus comprising:

a first duct of said plurality of ducts, equipped with a first, fixed, nozzle, configured to deliver at a constant volume flow, a first fresh gas input to the at least one breathing bag, an additional duct of said plurality of ducts, equipped with a demand regulator configured to deliver an additional fresh gas input to the at least one breathing bag, said apparatus being characterised in that it further comprises at a location of said plurality of:

a second duct of said plurality of ducts, equipped with a gas flow regulator configured to deliver at a variable volume flow, a second fresh gas input to the at least one breathing bag, wherein said apparatus also comprises at least one diving condition sensor configured to measure at least one diving condition parameter taken from among a physiological parameter of the diver and a pressure of water surrounding said apparatus, and wherein, said apparatus is configured to control the gas flow regulator so as to make said variable volume flow vary, at least according to at least a data related to said at least one diving condition parameter.

2. The apparatus according to claim 1, wherein the at least one sensor is a physiological sensor.

3. The apparatus according to claim 2, wherein the at least one sensor is a ventilatory frequency sensor.

4. The apparatus according to claim 3, wherein the ventilatory frequency sensor is positioned on a portion of the breathing loop situated between the inlet of the mouthpiece and the outlet of the at least one breathing bag.

5. The apparatus according to claim 1, wherein the at least one sensor comprises a depth sensor.

6. The apparatus according to claim 1, further comprising an electronic control module configured to electronically control the gas flow regulator so as to make the variable volume flow, at least according to said data related to said at least one diving condition parameter.

7. The apparatus according to claim 1, comprising at least one physiological sensor configured to measure at least one physiological parameter of the diver and a depth sensor to measure the pressure of the water surrounding said apparatus, and wherein said apparatus is configured to control the gas flow regulator so as to make said variable volume flow, at least according to the physiological parameter of the diver and of the pressure.

8. The apparatus according to claim 1, wherein the gas flow regulator comprises a second nozzle having a variable cross-section so as to deliver a second variable volume flow input.

9. The apparatus according to claim 1, wherein the gas flow regulator comprises an intermittent opening valve and a nozzle having a fixed cross-section, said nozzle being coupled with said valve so as to deliver a second variable volume flow input.

10. The apparatus according to claim 1, wherein the gas flow regulator is formed of at least:

a fixed nozzle configured to deliver at a constant volume flow, a fresh gas input to the breathing bag, a solenoid valve configured to make the flow of said fresh gas input vary over time, so as to deliver at a variable volume flow, the second fresh gas input to the breathing bag, the solenoid valve and the fixed nozzle of the gas flow regulator being connected in series.

11. The apparatus according to claim 1, configured such that the variable volume flow delivered by the gas flow regulator is respectively less than or equal to the constant volume flow delivered by the fixed nozzle.

12. The apparatus according to claim 1, configured such that the constant volume flow $D_{1v}$ delivered by the fixed nozzle and the variable volume flow $D_{2V}$ delivered by the gas flow regulator are such that $k_1*(D_{1v}+D_{2v})\leq D_{2v}\leq k_2*(D_{1v}+D_{2v})$, with $k_1=0.1$ and $k_2=0.9$.

13. The apparatus according to claim 1, wherein the fixed nozzle is configured to deliver the first fresh gas input from a first pressurised gas tank and the gas flow regulator is configured to deliver the second fresh gas input from a second pressurised gas tank.

14. A Kit intended to equip a semi-closed circuit gas recycling scuba diving breathing apparatus, intended to be carried by a diver, the apparatus comprising a breathing loop intended to be connected to at least one gas tank, the breathing loop comprising at least one breathing bag having: an outlet connected to an inlet of a mouthpiece making it possible for the diver to breathe in the breathing loop, an inlet connected to an outlet of a recycling chamber of a gas exhaled by the diver and at least one inlet intended to be connected to at least one outlet of the at least one gas tank, the at least one breathing bag being configured to make is possible for mixing within it of a recycled gas coming from the recycling chamber and at least one fresh gas input, coming from the at least one gas tank, said at least one gas tank being connected to at least one inlet of the at least one breathing bag by at least one duct comprising:

a first, fixed, nozzle configured to deliver at a constant volume flow, a first fresh gas input to the at least one breathing bag, a demand regulator configured to deliver an additional fresh gas input to the at least one breathing bag, the kit comprising at least:

a gas flow regulator configured to deliver at a variable volume flow, a second fresh gas input by said at least one duct connected to the at least one breathing bag and to the at least one gas tank, at least one diving condition sensor, configured to measure at least one diving condition parameter taken from among a physiological parameter of the diver and a pressure of water surrounding said apparatus, said at least one sensor being configured to be carried by at least one from among the apparatus, the kit and the diver, an electronic control module configured to control the gas flow regulator so as to make said variable volume flow vary, at least according to a data related to said at least one diving condition parameter.

15. The kit according to claim 14, wherein the at least one diving condition sensor is a physiological sensor.

16. The kit according to claim 15, wherein the physiological sensor is a ventilatory frequency sensor.

17. The kit according to claim 16, wherein the ventilatory frequency sensor is configured to be positioned on the breathing loop between the inlet of the mouthpiece and the outlet of the at least one breathing bag.

18. The kit according to claim 14 further comprising a depth sensor configured to be connected to the electronic control module so as to make it possible for the electronic control module to control said variable volume flow according to at least a data of said depth sensor.

* * * * *